US008534361B2

(12) United States Patent
Plunkett et al.

(10) Patent No.: US 8,534,361 B2
(45) Date of Patent: Sep. 17, 2013

(54) MULTI-STAGE PRESSURE EQUALIZATION VALVE ASSEMBLY FOR SUBTERRANEAN VALVES

(75) Inventors: Kevin R. Plunkett, Broken Arrow, OK (US); Mark S. Megill, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 140 days.

(21) Appl. No.: 12/574,970

(22) Filed: Oct. 7, 2009

(65) Prior Publication Data

US 2011/0079394 A1 Apr. 7, 2011

(51) Int. Cl.
*E21B 34/10* (2006.01)

(52) U.S. Cl.
USPC ..... 166/332.7; 166/329; 251/348; 251/353; 137/462; 137/630.13

(58) Field of Classification Search
USPC ..... 166/324, 205, 235, 328, 329, 332.1, 166/332.3, 332.4, 332.7, 334.4; 251/347, 251/348, 349, 353, 172; 137/629, 630.13, 137/462
See application file for complete search history.

(56) References Cited

U.S. PATENT DOCUMENTS 3,273,649 A * 9/1966 Tamplen ..... 166/332.7
3,421,733 A 1/1969 Stewart, Jr.
3,667,505 A * 6/1972 Radig ..... 137/630.14
3,741,249 A 6/1973 Leutwyler
3,778,029 A 12/1973 Baker
3,799,204 A * 3/1974 Watkins et al. ..... 137/629
3,826,462 A * 7/1974 Taylor ..... 251/58
3,827,494 A 8/1974 Crowe
3,830,297 A * 8/1974 Cockrell ..... 166/322
3,845,818 A * 11/1974 Deaton ..... 166/322
3,849,218 A 11/1974 Beckwith et al.
3,850,242 A * 11/1974 Crowe ..... 166/324
3,853,175 A 12/1974 Boyadjieff et al.
3,854,502 A * 12/1974 Mott ..... 137/629
3,856,085 A * 12/1974 Holden et al. ..... 166/264
3,868,995 A * 3/1975 Crowe ..... 166/324
3,971,438 A * 7/1976 Crowe ..... 166/324
4,044,835 A * 8/1977 Mott ..... 166/322
RE29,471 E * 11/1977 Giroux ..... 166/334.2
4,100,969 A * 7/1978 Randermann, Jr. ..... 166/324

(Continued)

OTHER PUBLICATIONS

Andrews, Thad, et al., "Bidirectional Subsurface Mechanically Actuated Barrier Valve and Shifting Tool(s) Provide Superior Control and Reliability for Multistage Completions", OTC 21866, May 1-6, 2011.

(Continued)

*Primary Examiner* — Jennifer H Gay
(74) *Attorney, Agent, or Firm* — Steve Rosenblatt

(57) ABSTRACT

A downhole valve that operates on turning of a member having a passage through it with a control system also features a passage from above an uphole seat for the member which communicates to the isolated passage within the member when the valve is closed. The passage features a check valve assembly that preferably has redundant sealing features and filters to prevent debris entry. Pressure applied from above the closed member gets through the check valve assembly to equalize the higher pressure below the ball with the pressure raised in the ball from pressure application at the surface. Removal of the applied pressure reseats the check valve or valves to allow the hydraulic system to rotate the member while the member is no longer subject to a high differential pressure.

22 Claims, 2 Drawing Sheets

(56) References Cited

U.S. PATENT DOCUMENTS

| | | | | | |
|---|---|---|---|---|---|
| 4,103,744 | A | * | 8/1978 | Akkerman | 166/324 |
| 4,113,018 | A | | 9/1978 | Barrington et al. | |
| 4,130,166 | A | | 12/1978 | Akkerman et al. | |
| 4,131,216 | A | * | 12/1978 | Gerstenmaier et al. | 222/52 |
| 4,140,153 | A | * | 2/1979 | Deaton | 137/629 |
| 4,144,937 | A | * | 3/1979 | Jackson et al. | 166/373 |
| 4,197,879 | A | * | 4/1980 | Young | 137/629 |
| 4,278,130 | A | | 7/1981 | Evans et al. | |
| 4,288,165 | A | | 9/1981 | Fewel | |
| 4,289,165 | A | | 9/1981 | Fredd | |
| 4,368,871 | A | | 1/1983 | Young | |
| 4,386,734 | A | * | 6/1983 | Weible | 237/12.3 B |
| 4,446,922 | A | | 5/1984 | Bowyer et al. | |
| 4,448,216 | A | * | 5/1984 | Speegle et al. | 137/630 |
| 4,452,311 | A | * | 6/1984 | Speegle et al. | 166/324 |
| 4,478,286 | A | | 10/1984 | Fineberg | |
| 4,804,044 | A | * | 2/1989 | Wesson et al. | 166/297 |
| 4,915,171 | A | * | 4/1990 | McMahan | 166/264 |
| 5,052,657 | A | | 10/1991 | Winship | |
| 5,117,913 | A | * | 6/1992 | Themig | 166/310 |
| 5,346,178 | A | | 9/1994 | Baker | |
| 5,564,502 | A | | 10/1996 | Crow et al. | |
| 5,865,246 | A | | 2/1999 | Brown | |
| 5,890,698 | A | * | 4/1999 | Domytrak | 251/1.1 |
| 5,893,389 | A | * | 4/1999 | Cunningham | 137/516.27 |
| 6,148,843 | A | * | 11/2000 | Pringle | 137/155 |
| 6,223,824 | B1 | | 5/2001 | Moyes | |
| 6,260,850 | B1 | | 7/2001 | Beall et al. | |
| 6,283,217 | B1 | | 9/2001 | Deaton | |
| 6,296,061 | B1 | | 10/2001 | Leismer | |
| 6,644,408 | B2 | | 11/2003 | Ives | |
| 6,695,286 | B1 | | 2/2004 | Florio et al. | |
| 6,698,712 | B2 | | 3/2004 | Milberger et al. | |
| 6,708,946 | B1 | | 3/2004 | Edwards et al. | |
| 6,848,509 | B2 | | 2/2005 | Myerley | |
| 6,866,100 | B2 | | 3/2005 | Gudmestad et al. | |
| 7,537,052 | B2 | | 5/2009 | Robichaux et al. | |
| 7,614,452 | B2 | * | 11/2009 | Kenison et al. | 166/321 |
| 2001/0045285 | A1 | | 11/2001 | Russell | |
| 2002/0153142 | A1 | * | 10/2002 | Eslinger et al. | 166/305.1 |
| 2003/0056951 | A1 | * | 3/2003 | Kaszuba | 166/250.01 |
| 2004/0035586 | A1 | * | 2/2004 | Gudmestad et al. | 166/373 |
| 2004/0220448 | A1 | * | 11/2004 | Henkel et al. | 600/40 |
| 2004/0226721 | A1 | * | 11/2004 | Feluch et al. | 166/332.4 |
| 2006/0076062 | A1 | * | 4/2006 | Andersson | 137/512 |
| 2006/0243329 | A1 | * | 11/2006 | Doble | 137/542 |
| 2007/0113900 | A1 | * | 5/2007 | Greene et al. | 137/462 |
| 2007/0119789 | A1 | * | 5/2007 | Layton | 210/805 |
| 2008/0110632 | A1 | | 5/2008 | Beall | |
| 2008/0217248 | A1 | * | 9/2008 | Gebauer | 210/656 |
| 2008/0271603 | A1 | * | 11/2008 | Triplett et al. | 95/150 |
| 2009/0020291 | A1 | | 1/2009 | Wagner et al. | |
| 2009/0050549 | A1 | * | 2/2009 | Kerfoot | 210/139 |
| 2009/0184278 | A1 | | 7/2009 | Beall et al. | |
| 2011/0079394 | A1 | * | 4/2011 | Plunkett et al. | 166/324 |
| 2011/0088906 | A1 | * | 4/2011 | Myerley | 166/324 |

OTHER PUBLICATIONS

Nowlin, Jr., W.D., et al., "Overview of Classes of Currents in the deep water region of the Gulf of Mexico", OTC 12991, May 1-7, 2001.

Instanes, Geir, et al, "Acoustic Leak Monitoring on Subsea Valves", SPE 114256, Oct. 1-5, 2008.

Andrews, Thad, et al., Bidirectional Subsurface Mechanically Actuated Barrier Valve and Shifting Tool(s) Provide Superior Control and Reliability for Multistage Completions, OTC 21866, May 1-6, 2011.

Instanes, Geir, et al., "Acoustic Leak Monitoring on Subsea Valves", SPE 114256, Oct. 1-5, 2008.

Nowlin, W.D. Jr., et al., "Oveview of Calsses of Currents in the deep water region of The Gulf of Mexico", OTC 12991, May 1-7, 2001.

* cited by examiner

MULTI-STAGE PRESSURE EQUALIZATION VALVE ASSEMBLY FOR SUBTERRANEAN VALVES

FIELD OF THE INVENTION

The field of this invention is an equalizing pressure feature for subterranean or downhole valves and more particularly a way to equalize trapped lower pressure in a ball or plug of a valve without having to run a tool in the valve.

BACKGROUND OF THE INVENTION

Downhole valves are used to isolate portions of the wellbore for a variety of reasons such as for safety systems or to allow building a long bottom hole assembly in the wellbore, to name a few examples. Such valves have featured a rotating ball with a bore through it that can be aligned or misaligned with the path through the tubing string where the valve is mounted. The ball is surrounded by a sliding cage that is operated by a hydraulic control system from the surface. One such design features opposed pistons actuated by discrete control lines. This design was concerned about a pressure imbalance on an operating piston and provided a passage through the piston with two check valves 54, 76 in series to allow pressure equalization across the actuating piston with the ball in the closed position.

What can happen in this type of a ball valve that has upper and lower seats against the ball in the closed position is that pressure from downhole can rise, which leads to a pressure differential between the passage inside the ball and the downhole pressure. This pressure differential can distort the ball and make it hard or impossible for the piston actuation system to operate the ball back into the open position. One way this was solved is described in a commonly assigned application Ser. No. 12/366,752 filed on Feb. 6, 2009 and having the title Pressure Equalization Device for Downhole Tools. The solution described in this application was to use a tool that goes into the upper sleeve that hold a seat against the ball and separate the seat from the ball while providing pressure from the surface at the same time to equalize the pressure on the ball before trying to rotate it to the open position. The problem with this technique was that it required a run into the well with coiled tubing, latching and shifting the upper sleeve and associated seat enough to give access into the ball for equalizing pressure. One of the downsides of this technique was that the pressure admitted to try to equalize the pressure in the ball could be high enough to unseat the lower seat from the ball so that the higher pressure below the ball would get to above the ball. This technique also took time which cost the operator money and required specialized equipment at the well location, which could be remote or offshore and add yet additional costs to the effort to operate the ball when subjected to high differential pressures that could distort the ball enough to make it hard for the hydraulic system to rotate it.

In flapper type safety valves such as U.S. Pat. No. 5,564,502 the preferred method to get pressure equalization on a closed flapper was to simply apply tubing pressure on top of it to reduce the differential before using the control system to try to rotate the flapper. Of course, the flapper is built to rotate open with pressure applied above so that this technique did not equalize pressure around the flapper when it was closed but simply built up pressure above it when it was closed. Other equalizer valves mounted in the flapper were actuated by the hydraulic system moving down a flow tube that impacted the equalizing valve before the flapper was engaged by the flow tube as seen in U.S. Pat. Nos. 6,848,509 or 4,478,286.

The present invention manages to equalize pressure by simple application of pressure from the surface that can communicate to inside the ball in the closed position for pressure equalization. That pressure communicated through a passage in the housing that selectively communicates the zone above the closed ball to the isolated passage within the ball when the ball is in the closed position. That communication preferably occurs through a check valve assembly that preferably has a series redundant feature and screens to assure that on removal of the applied pressure that the check valve passage will reclose allowing for normal ball operation to open the ball with the hydraulically actuated operating piston or pistons. These and other features of the present invention will be more readily appreciated by those skilled in the art from a review of the specification and associated drawings while understanding that the full scope of the invention is to be found in the appended claims.

SUMMARY OF THE INVENTION

A downhole valve that operates on turning of a member having a passage through it with a control system also features a passage from above an uphole seat for the member which communicates to the isolated passage within the member when the valve is closed. The passage features a check valve assembly that preferably has redundant sealing features and filters to prevent debris entry. Pressure applied from above the closed member gets through the check valve assembly to equalize the higher pressure below the ball with the pressure raised in the ball from pressure application at the surface. Removal of the applied pressure reseats the check valve or valves to allow the hydraulic system to rotate the member while the member is no longer subject to a high differential pressure.

DETAILED DESCRIPTION OF THE PREFERRED EMBODIMENT

Figure 1:
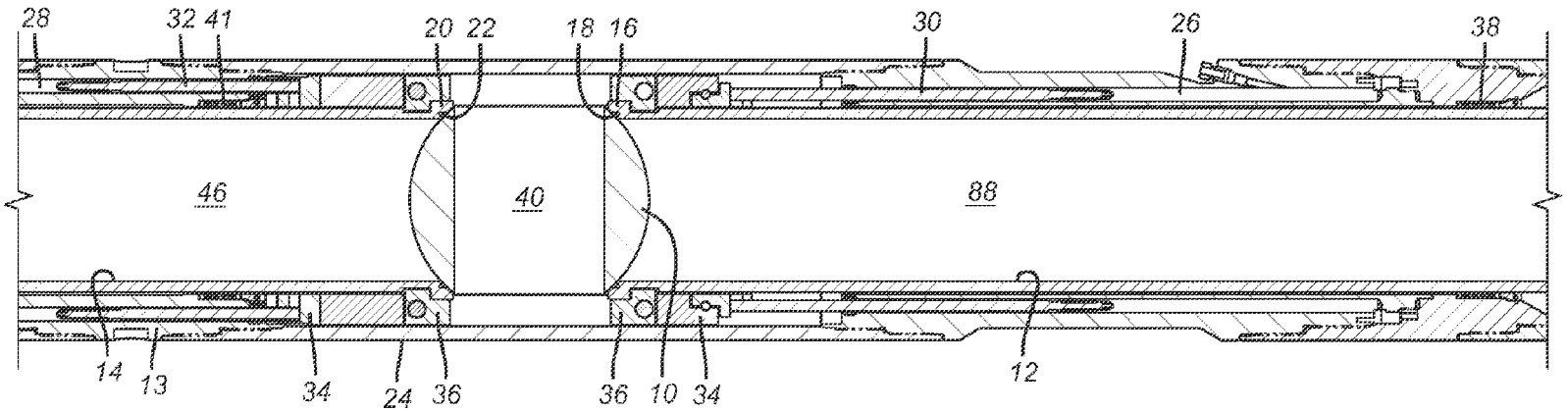
FIG. 1 is a section view through a ball valve showing the major component and taken at a section rotated from the section of FIG. 2 where the check valve assembly is located.
Figure 2:
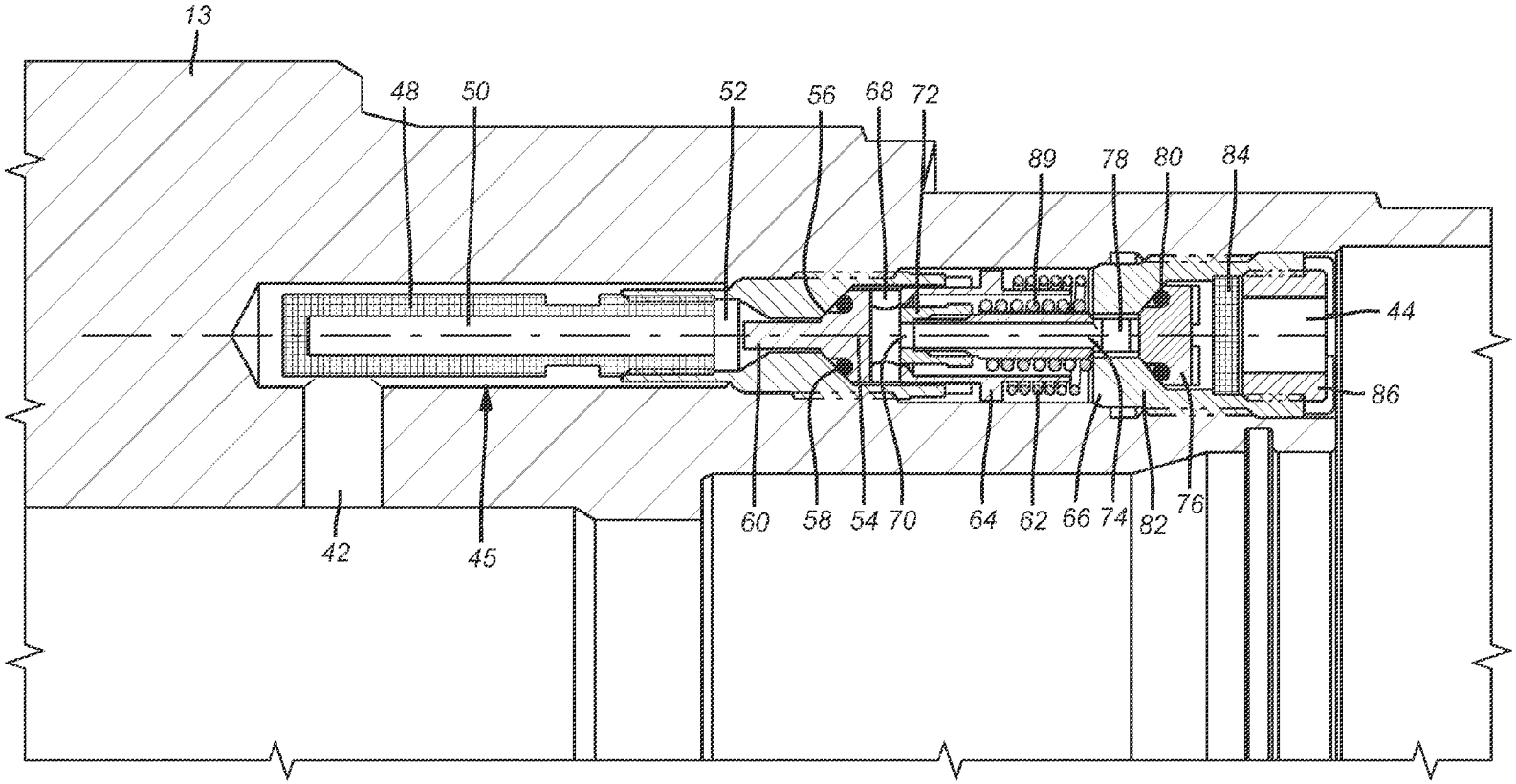
FIG. 2 is a section through a housing component shown in FIG. 1 but rotated to a different plane to illustrate the passage and the check valve assembly within the passage that allows pressure equalization within the ball when it is closed prior to actuating the hydraulic system to open the ball.

The basic components of the valve of FIG. 1 are reviewed in more detail in US Publication 2008/0110632 whose description is fully incorporated by reference herein as though full set forth. The portions of such valve relevant to the understanding of the present invention will be reviewed below in sufficient detail and for completeness so as to fully understand the operation of the claimed invention.

FIG. 1 shows a ball valve in the closed position. The ball 10 has a lower seat sleeve 12 below it and an upper seat sleeve 14 above it. Seat 16 with seal 18 is pushed by a spring assembly (not shown) against the ball 10. Seat 20 with seal 22 is supported against axial movement by the housing 24 such that the bias on the lower sleeve 12 pushes the seat 16 against the ball 10 and in turn pushes the ball 10 against the seat 20. Control lines (not shown) are in fluid communication with inlet passages 26 and 28 that respectively lead to operating pistons 30 and 32. Pistons 30 and 32 are preferably rod pistons that at the opposite ends from passages 26 and 28 are connected to a sliding cage 34 at the opposed ends of cage 34 so as to selectively reciprocate the cage 34 axially in opposed directions for normal opening and closing of the ball 10. Ball 10 is held in a stationary frame 36 that is an open structure to accept the passage of cage 34 as it is pushed to axially reciprocate by pistons 30 and 32. Frame 36 supports the ball 10 to rotate on its central axis on opposed pin supports that are not shown. The ball 10 is also pinned to the cage 34 at a location away from the central axis of the ball so that relative axial movement of the cage 34 with respect to the frame 36 rotates the ball 10 90 degrees in opposed directions depending on the direction of the relative movement of cage 34 caused by selective pressure application to passage 26 or 28. Note that seal 38 keeps pressure in the tubing below the closed ball 10 from entering passage 40 and a similar seal 41 against the upper sleeve 14 keeps pressure in the tubing above the closed ball 10 out of inlet passage 40. With ball 10 in the closed position of FIG. 1 its passage 40 is isolated from tubing pressure below the ball 10 by seals 18 and 38. This pressure differential can be high enough to cause distortion of ball 10 to the point where there can be damage to the hydraulic system that is trying to turn the ball 10 while exposed to such high pressure differentials.

The present invention addresses how to equalize ball 10 when subject to a high differential pressure before trying to move it. While the preferred embodiment is a 90 degree ball, the present invention is applicable to other downhole devices that because of their configuration can become exposed to pressure differentials that need equalization to prevent actuation system damage or damage to the element to be operated by the actuation system. The present invention allows the use of tubing pressure from above to equalize pressure so that the member or ball can then be rotated or operated in the normal manner without damage to any components.

Generally speaking, a bypass passage starts at an inlet 42 and continues to an outlet 44. Inlet 42 is in housing component 13 and is not seen in the section view of FIG. 1 because it is rotated about 90 degrees from the bore for piston 32. Inlet 42 needs to communicate with tubing pressure and will be located above the end of sleeve 14 such that pressure applied from above the closed ball 10 into passage 46 will reach the inlet 42. At the other end at outlet 44 the passage 45 communicates with the low pressure passage 40 in ball 10 when ball 10 is in the closed position.

All fluids entering inlet 42 go through filter 48 into its internal passage 50 and then into chamber 52. Check valve member 54 has a taper 56 with a seal 58 with an elongated end 60 that keeps valve member 54 centered as it moves axially against the bias of spring 62 that pushes on tab 64 on one end and housing 66 at the opposite end. Member 54 also has ports 68 that allow flow to enter once member 54 is pushed enough against spring 62 to lift the seal 58 away from the opposing tapered sealing surface on the housing 66. Flow around member 54 goes through opening 70 in retainer 72 that is attached to check valve member 76 and then through passage 74. Flow continues through passages 78 where it pushes seal 80 mounted on a tapered surface away from a mating tapered surface on housing 82 so that flow can go around the outside of the member 76 to reach the screen 84 held to housing 82 by retainer nut 86 through which is found the outlet 44. Removal of applied pressure at inlet 42 allows springs 62 and 89 to respectively move members 54 and 76 to put seals 56 and 80 against their respective tapered surfaces in housings 66 and 82. The ball 10 is equalized as between the pressure in passage 40 and the pressure at 88 below the ball 10 using the flow through passage 45 resulting from pressure applied above ball 10 to passage 46. The ball 10 can then be operated in the normal manner with the previously described hydraulic system.

Those skilled in the art will appreciate that there are two stacked check valve assemblies and that a single or more than two assemblies in series are contemplated. Filters 48 and 84 prevent debris from entering passage 45 when flow direction reverses to enhance the sealing integrity of the seals 56 and 80.

The equalizing system that is described works on applied tubing pressure from above that is simple to provide and it is the applied pressure that operates the equalizing valve or valves to get pressure balance on the final controlled element such as ball 10 so that it can then be operated in the usual manner with a surface controlled hydraulic system. The application of the invention is to a broad range of tools that operate downhole where in a given position there could exist substantial pressure differential across a powered component that has to be overcome before trying to actuate that component so that damage to the actuating system or the component can be avoided. In the preferred embodiment the final controlled element is ball 10 and the actuating system is hydraulic and operated from the surface with a control line or lines actuating one or more pistons to cause ball rotation. The pressure differential across a ball 10 when closed can cause elastic ball distortion that can make it difficult or impossible within the capacity of the hydraulic actuating system components to operate the ball 10 when subject to such differential pressures without damage to the ball 10 itself or more likely the components of the hydraulic system such as pistons 30 or 32 or seals associated with such pistons. The equalizing system does not depend on forcing pistons against components and for that reason can be simply operated from the surface of a well without additional specialty equipment. The applied pressure directly operates the equalizing system, making it far more reliable than another system that adds movement of mechanical components just to open the equalizing valve or valves.

The above description is illustrative of the preferred embodiment and many modifications may be made by those skilled in the art without departing from the invention whose scope is to be determined from the literal and equivalent scope of the claims below.

We claim:

1. A pressure equalizing system for a subterranean tool, comprising:

a movable component in a housing having a housing passage extending from an uphole end to a downhole end, said component having at least two positions where said passage is open and closed and configured in said passage to trap pressure in a first zone of said housing when said movable component is placed in a first position where said passage is closed and where said trapped pressure is at a lower pressure than pressure isolated adjacent said downhole end by said movable component in said first position;

a bypass within a wall of said housing having an inlet in said passage with access to said uphole end and ending in said zone so that pressure at a predetermined level delivered to said uphole end from within said passage selectively opens a re-closable valve mounted wholly in said bypass to equalize pressure in said zone with pressure near said isolated downhole end of said passage to facilitate moving said movable member to a second position, said valve automatically closing on reduction of uphole end pressure below said predetermined level.

2. The system of claim 1, wherein:

said bypass extends through a wall of said housing.

3. The system of claim 2, wherein:

said bypass extends axially in the wall of said housing from said inlet between said uphole end and said movable member and an outlet into said zone.

4. The system of claim 3, wherein:

said movable member comprises a ball having a flow passage therethrough;

said zone is defined in part by said flow passage when said ball is positioned to close said housing passage.

5. The system of claim 3, wherein:

said bypass comprises at least one screen.

6. The system of claim 5, wherein:

said at least one screen comprises two screens with one screen near said inlet and the other near said outlet.

7. A pressure equalizing system for a subterranean tool, comprising:

a movable component in a housing having a housing passage extending from an uphole end to a downhole end, said component having at least two positions where said passage is open and closed and configured in said passage to trap pressure in a first zone of said housing when said movable component is placed in a first position where said passage is closed and where said trapped pressure is at a lower pressure than pressure isolated adjacent said downhole end by said movable component in said first position;

a bypass within a wall of said housing having an inlet in said passage with access to said uphole end and ending in said zone so that pressure at a predetermined level delivered to said uphole end from within said passage selectively opens a re-closable valve mounted wholly in said bypass to equalize pressure in said zone with pressure near said isolated downhole end of said passage to facilitate moving said movable member to a second position, said valve automatically closing on reduction of uphole end pressure below said predetermined level;

said passage further comprises at least one check valve.

8. The system of claim 7, wherein:

said at least one check valve comprises a plurality of check valves.

9. The system of claim 8, wherein:

said check valves are disposed in series in said bypass.

10. The system of claim 9, wherein:

said bypass comprises at least one screen.

11. The system of claim 10, wherein:

said at least one screen comprises two screens with one screen near said inlet and the other near said outlet.

12. The system of claim 11, wherein:

said check valves are located between said screens.

13. The system of claim 7, wherein:

said check valve comprises a valve member having an elongated stem leading to a tapered surface that further comprises a seal, said check valve further comprising a housing to guide said stem and an opposing tapered surface to said tapered surface on said valve member and a biasing member to push said tapered surfaces toward each other.

14. The system of claim 13, wherein:

said stem defines a flow path that upon application of pressure therein displaces said valve member against said biasing member to permit flow in one direction only.

15. A pressure equalizing system for a subterranean tool, comprising:

a movable component in a housing having a housing passage extending from an uphole end to a downhole end, said component having at least two positions where said passage is open and closed and configured in said passage to trap pressure in a first zone of said housing when said movable component is placed in a first position where said passage is closed and where said trapped pressure is at a lower pressure than pressure isolated adjacent said downhole end by said movable component in said first position;

a bypass within a wall of said housing having an inlet in said passage with access to said uphole end and ending in said zone so that pressure at a predetermined level delivered to said uphole end from within said passage selectively opens a re-closable valve mounted wholly in said bypass to equalize pressure in said zone with pressure near said isolated downhole end of said passage to facilitate moving said movable member to a second position, said valve automatically closing on reduction of uphole end pressure below said predetermined level;

said bypass extends through a wall of said housing;

said bypass extends axially in the wall of said housing having an inlet between said uphole end and said movable member and an outlet into said zone;

said movable member comprises a ball having a flow passage therethrough;

said zone is defined in part by said flow passage when said ball is positioned to close said housing passage;

said passage comprises at least one check valve.

16. The system of claim 15, wherein:

said at least one check valve comprises at least two check valves.

17. The system of claim 16, wherein:

said check valves are disposed in series in said bypass.

18. The system of claim 17, wherein:

said bypass comprises at least one screen.

19. The system of claim 18, wherein:

said at least one screen comprises two screens with one screen near said inlet and the other near said outlet and said check valves in between.

20. The system of claim 19, further comprising:

an upper seat sleeve located between said uphole end and said ball and a lower seat sleeve located between said downhole end and said ball;

said sleeves each presenting a seat in contact with said ball when said ball is in a first position defining said zone with said flow passage therethrough with pressure in said lower sleeve isolated from pressure in said upper sleeve with said zone in between;

said sleeves externally sealed to said housing passage.

21. The system of claim 20, wherein:

said inlet to said bypass located between said uphole end and said upper seat sleeve.

22. A pressure equalizing system for a subterranean tool, comprising:

a movable component in a housing having a housing passage extending from an uphole end to a downhole end, said component having at least two positions where said passage is open and closed and configured in said passage to trap pressure in a first zone of said housing when said movable component is placed in a first position where said passage is closed and where said trapped pressure is at a lower pressure than pressure isolated adjacent said downhole end by said movable component in said first position;

a bypass within a wall of said housing having an inlet in said passage with access to said uphole end and ending in said zone so that pressure at a predetermined level delivered to said uphole end from within said passage selectively opens a re-closable valve mounted wholly in said bypass to equalize pressure in said zone with pressure near said isolated downhole end of said passage to facilitate moving said movable member to a second position, said valve automatically closing on reduction of uphole end pressure below said predetermined level;

said bypass extends through a wall of said housing, said bypass extends axially in the wall of said housing having an inlet between said uphole end and said movable member and an outlet into said zone;

said bypass comprises at least one screen;

said at least one screen comprises two screens with one screen near said inlet and the other near said outlet;

said passage further comprises at least one check valve between said screens.

* * * * *